US012145026B2

(12) United States Patent
Godoy

(10) Patent No.: US 12,145,026 B2
(45) Date of Patent: Nov. 19, 2024

(54) SWIMMING AND SCUBA DIVING FIN WITH AN ADJUSTABLE ELASTIC HEEL STRAP

(71) Applicant: CRESSI-SUB S.P.A., Genoa (IT)

(72) Inventor: Carlos Alberto Godoy, Genoa (IT)

(73) Assignee: CRESSI-SUB S.P.A., Genoa (IT)

( * ) Notice: Subject to any disclaimer, the term of this patent is extended or adjusted under 35 U.S.C. 154(b) by 496 days.

(21) Appl. No.: 17/547,466

(22) Filed: Dec. 10, 2021

(65) Prior Publication Data

US 2022/0184459 A1 Jun. 16, 2022

(30) Foreign Application Priority Data

Dec. 15, 2020 (IT) ..... 102020000030950

(51) Int. Cl.

| | |
|---|---|
| ***A63B 31/11*** | (2006.01) |
| ***A43B 5/08*** | (2006.01) |
| ***A43B 21/42*** | (2006.01) |
| ***A43C 11/22*** | (2006.01) |

(52) U.S. Cl.

CPC ..... *A63B 31/11* (2013.01); *A43B 5/08* (2013.01); *A43B 21/42* (2013.01); *A43C 11/22* (2013.01)

(58) Field of Classification Search

CPC ..... A63B 31/11; A43B 5/08; A43C 11/22; A43C 11/12; A43C 11/14; B63C 2011/128

See application file for complete search history.

(56) References Cited

U.S. PATENT DOCUMENTS

| | | | | |
|---|---|---|---|---|
| 4,795,384 A | | 1/1989 | Hattori | |
| 4,795,385 A | * | 1/1989 | Matsuoka | A63B 31/11 D21/806 |
| 6,341,383 B1 | * | 1/2002 | Beltrani | A63B 31/08 2/452 |
| 2008/0250618 A1 | * | 10/2008 | Stramare | A43C 7/08 24/712.7 |

FOREIGN PATENT DOCUMENTS

| | | | | |
|---|---|---|---|---|
| CN | 115426915 A | * | 12/2022 | A43C 11/20 |

OTHER PUBLICATIONS

Camcleat "https://www.premiumropes.com/clam-cleat-2171-clam-cleat-side-entry-starboard-3-6mm", retried Jun. 2024 (Year: 2023).*

European Search Report issued in EP Application No. 21209469 dated Apr. 28, 2022.

* cited by examiner

*Primary Examiner* — Andrew Polay

(74) *Attorney, Agent, or Firm* — TROUTMAN PEPPER HAMILTON SANDERS LLP

(57) ABSTRACT

A swimming/scuba diving fin having a blade, a shoe open at the rear, an adjustable elastic strap engageable around the heel of the scuba diver, and two buckles at opposite ends of said adjustable elastic strap connected to two opposed side walls of said shoe, where at least one said buckle has a shaped hollow body forming integrally a portion connecting to said side wall, a channel for the axial sliding of the adjustable elastic strap, and a releasable fastening clamp of the adjustable elastic strap, where such an axial sliding channel has a hole for the inlet of the adjustable elastic strap, a hole for the outlet of the adjustable elastic strap and a deflection angle of the adjustable elastic strap positioned between such an inlet hole and such an outlet hole.

18 Claims, 8 Drawing Sheets

SWIMMING AND SCUBA DIVING FIN WITH AN ADJUSTABLE ELASTIC HEEL STRAP

CROSS REFERENCE TO RELATED APPLICATION

This application claims benefit of priority to Italian Patent Application No. 102020000030950, filed Dec. 15, 2020. The entire contents of which are hereby incorporated by reference.

FIELD OF THE INVENTION

The present invention relates to a swimming and/or scuba diving fin with an adjustable elastic heel strap.

BACKGROUND

Swimming and/or scuba diving fins have been on the market for some time and feature a blade, a shoe open at the rear and an adjustable strap engageable around the user's heel, for locking the foot in the shoe.

It is known that the strap must be adjustable for the different sizes of the scuba diver's foot, which must be able to use the fin both without and with specific underwater footwear.

As is already known, elastic straps have been on the market for some time, which engage the user's heel.

Such traditional straps are known to imply a difficulty in both proper tensioning once the fin is worn and rapid release if necessary by the user.

Such straps are notoriously ineffective, also because the traditional fastening systems of the elastic element to the shoe open at the rear do not allow a simple and effective insertion and engagement of the user's heel.

There is therefore a need to simplify the structure of the adjustable elastic heel straps for known swimming and/or scuba diving fins.

SUMMARY

The technical task of the present invention is, therefore, to provide a swimming/scuba diving fin which obviates the above-described technical drawbacks of the prior art.

As part of this technical task, an object of the invention is to make a swimming/scuba diving fin with a shoe open at the rear in which the heel strap is easily adjustable in tension.

Another object of the invention is to make a swimming/scuba diving fin with a shoe open at the rear in which the heel strap is easily engageable in tension.

Another object of the invention is to make a swimming/scuba diving fin in which the strap has fastening means to the shoe open at the rear which allow a simple and effective insertion and engagement of the user's heel.

Not least, an object of the invention is to make a swimming/scuba diving fin with a shoe open at the rear in which the fastening means of the elastic strap to the shoe open at the rear and the fastening means of the tension of the strap are simple and of compact design.

The technical task, as well as these and other objects, according to the present invention are achieved by making a swimming/scuba diving fin having a blade, a shoe open at the rear, an adjustable elastic strap engageable around the heel of the scuba diver, and two buckles at the opposite ends of the strap connected to respective opposed side walls of said shoe, characterized in that at least one buckle has at least one shaped hollow body integrally forming a portion connecting to the side wall of the shoe, at least one channel for the axial sliding of the strap, and at least one releasable fastening clamp of the strap, the axial sliding channel having a hole for the inlet of the strap, a hole for the outlet of the strap and a deflection angle of the strap positioned between the inlet hole and the outlet hole.

In a preferred embodiment, the releasable fastening clamp is positioned outside said sliding channel.

In a preferred embodiment, the releasable fastening clamp has two opposite jaws which delimit a fastening groove where said strap can be introduced and extracted crosswise.

In a preferred embodiment, the opposite jaws have a reciprocal distance which is less than the diameter at rest of the strap.

In a preferred embodiment, the buckle is made as a single piece by moulding polymer resins.

In a preferred embodiment, the strap is configured to reduce in diameter when it moves from a rest state to a state of tensile stress.

Other features of the present invention are defined, further, in the following claims.

BRIEF DESCRIPTION OF THE DRAWINGS

Further features and advantages of the invention will become more apparent from the description of a preferred, but not exclusive, embodiment of a swimming/scuba diving fin according to the invention, illustrated by way of indicative and non-limiting example in the accompanying drawings, in which.

DETAILED DESCRIPTION OF THE DRAWINGS

Figure 1:
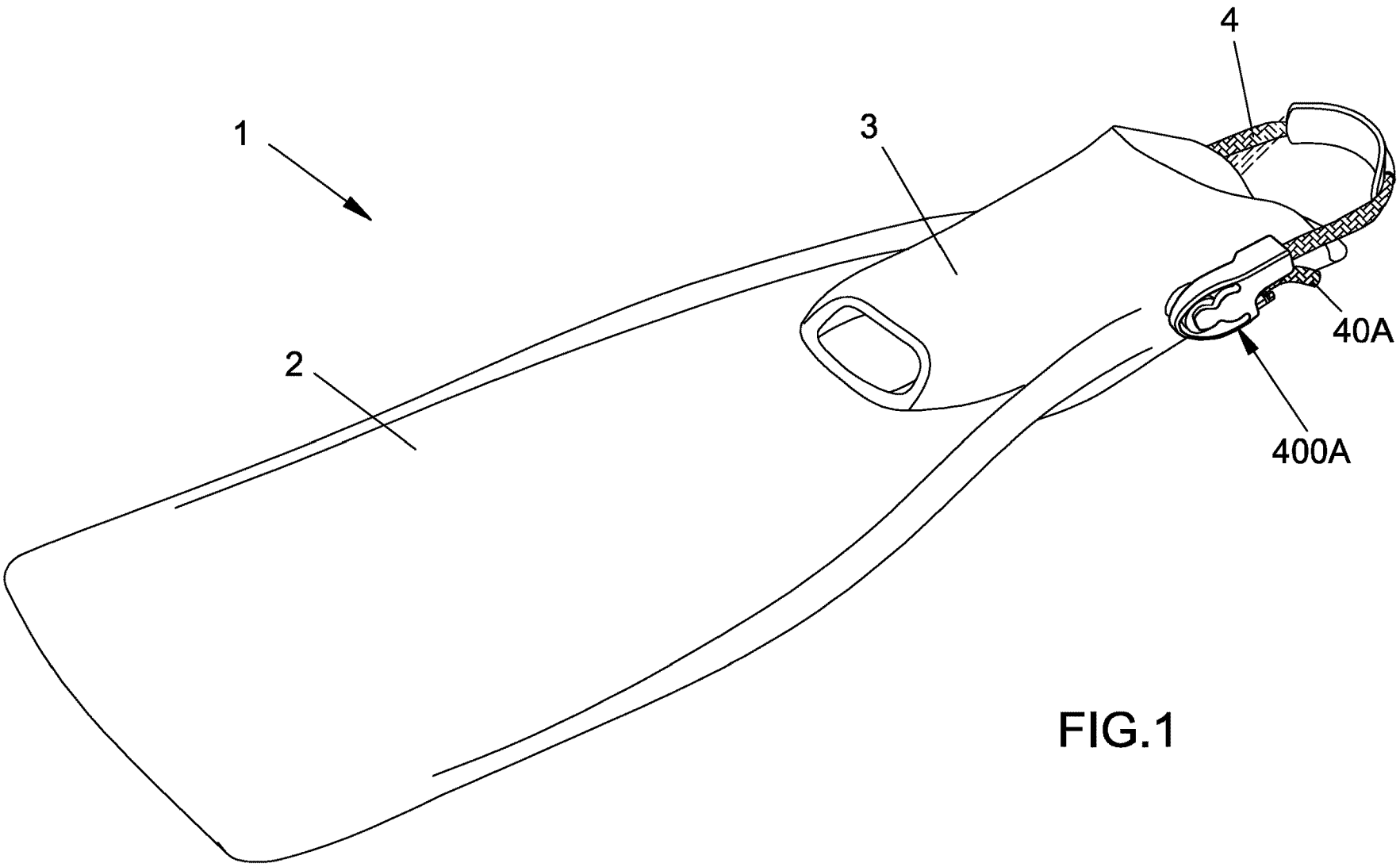
FIG. 1 shows a complete assembly view of a fin
Figure 2:
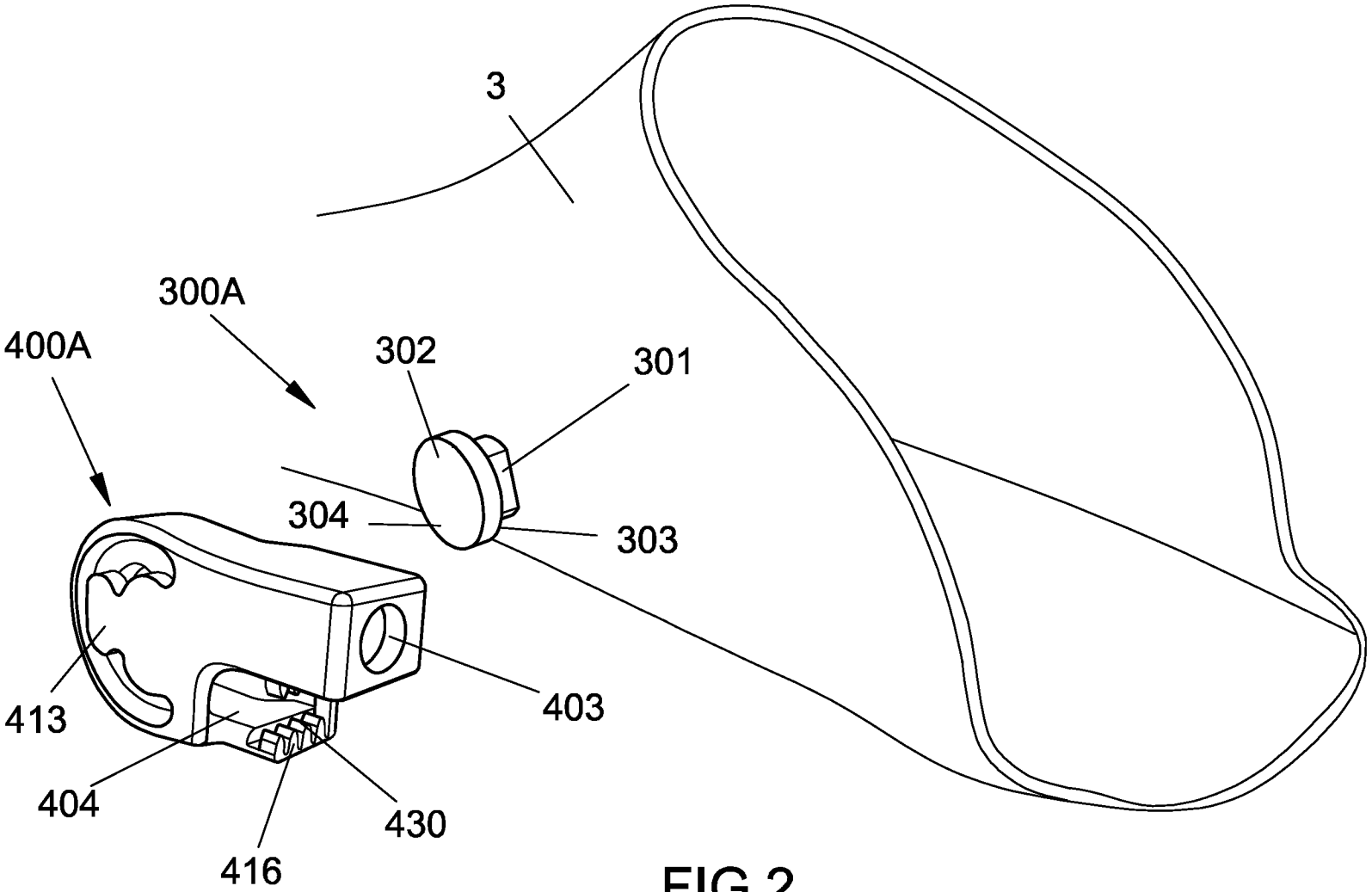
FIG. 2 shows a rear view of the shoe, hinging pin and buckle of the strap.
Figure 3A:
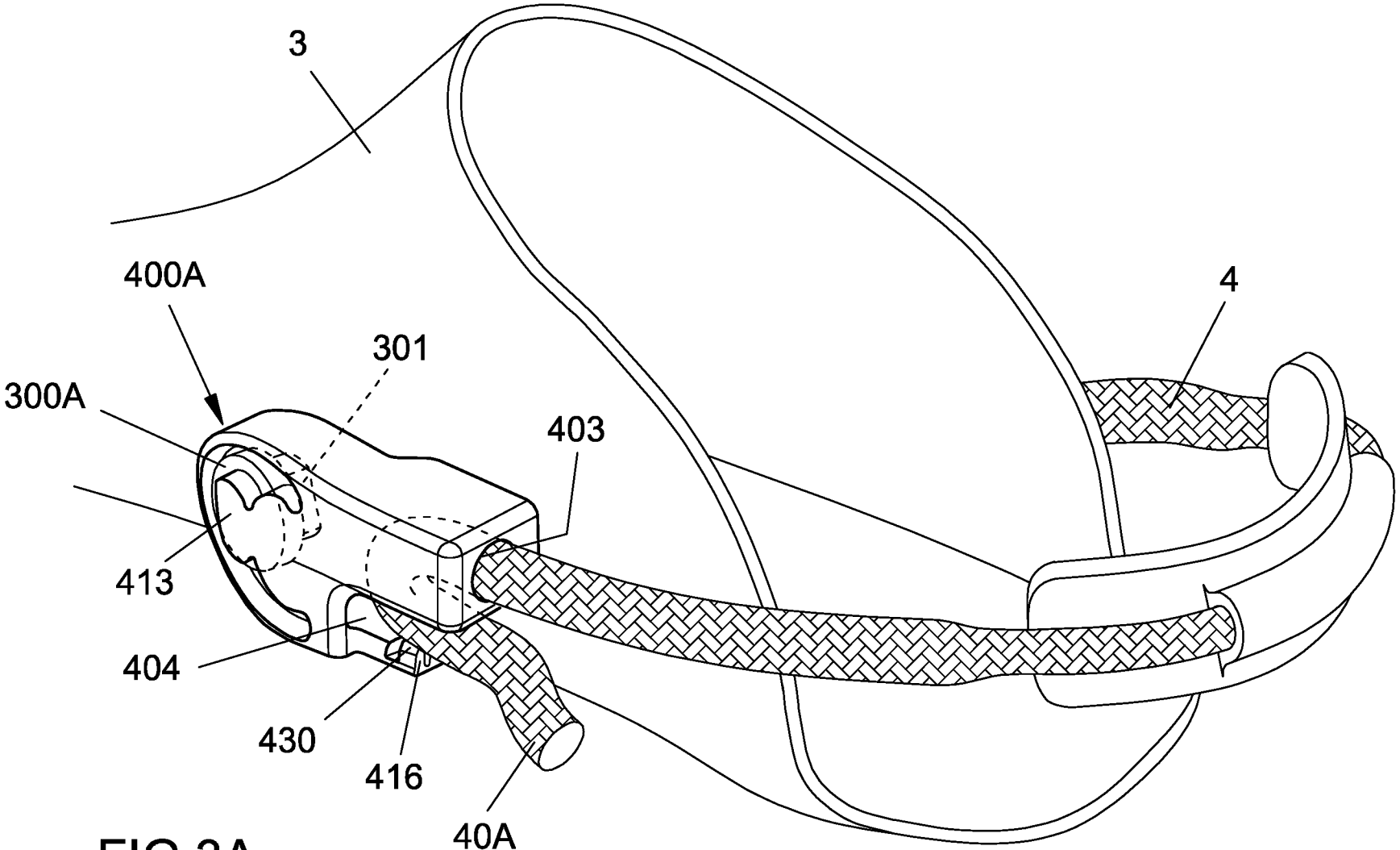
FIG. 3 A shows a rear assembly view of the shoe, the buckle and the strap mutually engaged, and in particular with the strap engaged in the buckle clamp.
FIG. 3B shows a rear assembly view of the shoe, the buckle and the strap mutually disengaged, and in particular with the strap disengaged from the buckle clamp.
Figure 3B:
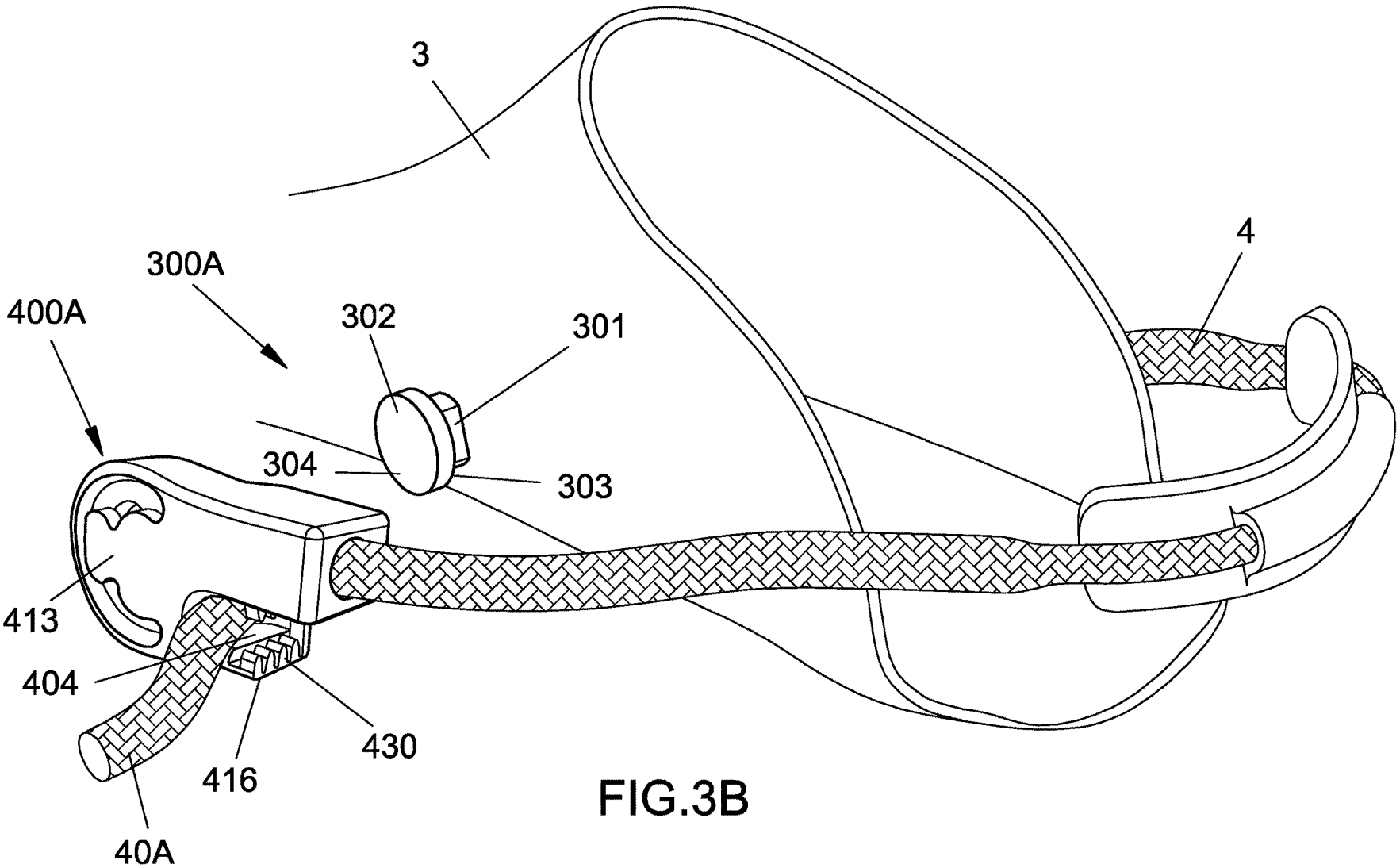
Figure 4:
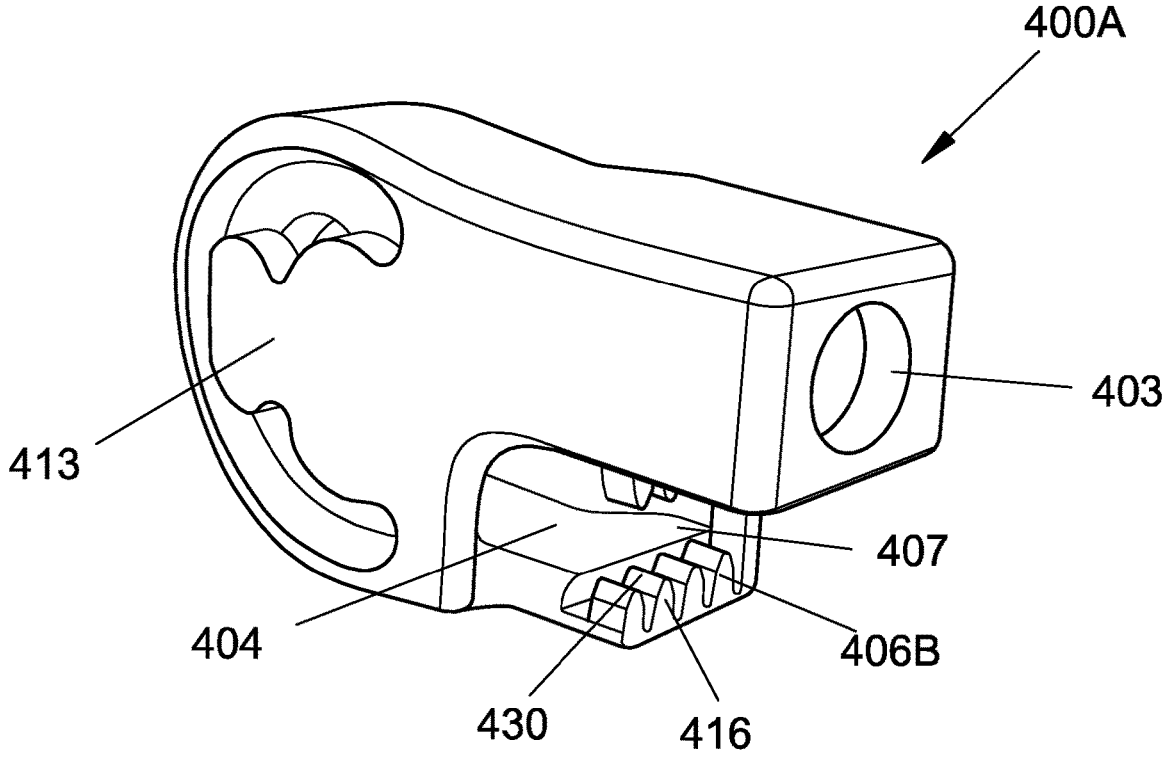
FIG. 4 shows a perspective view of the buckle.
Figure 5A:
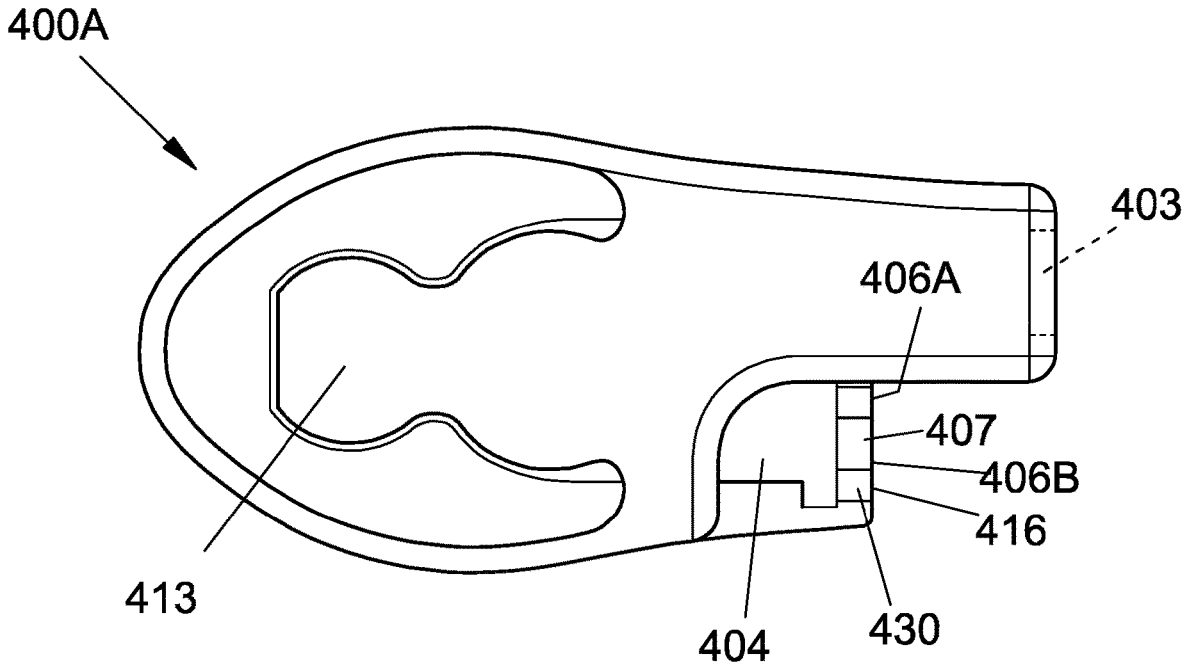
FIGS. 5A, 5B, 5C show two views and a section of the buckle.
Figure 5B:
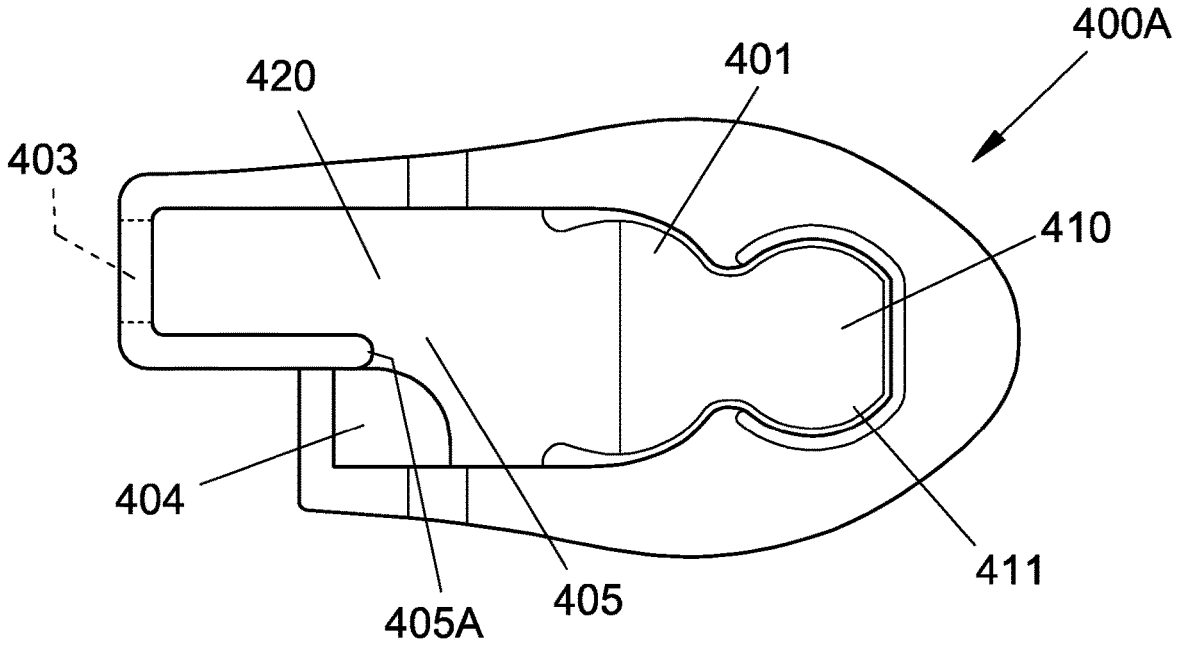
Figure 5C:
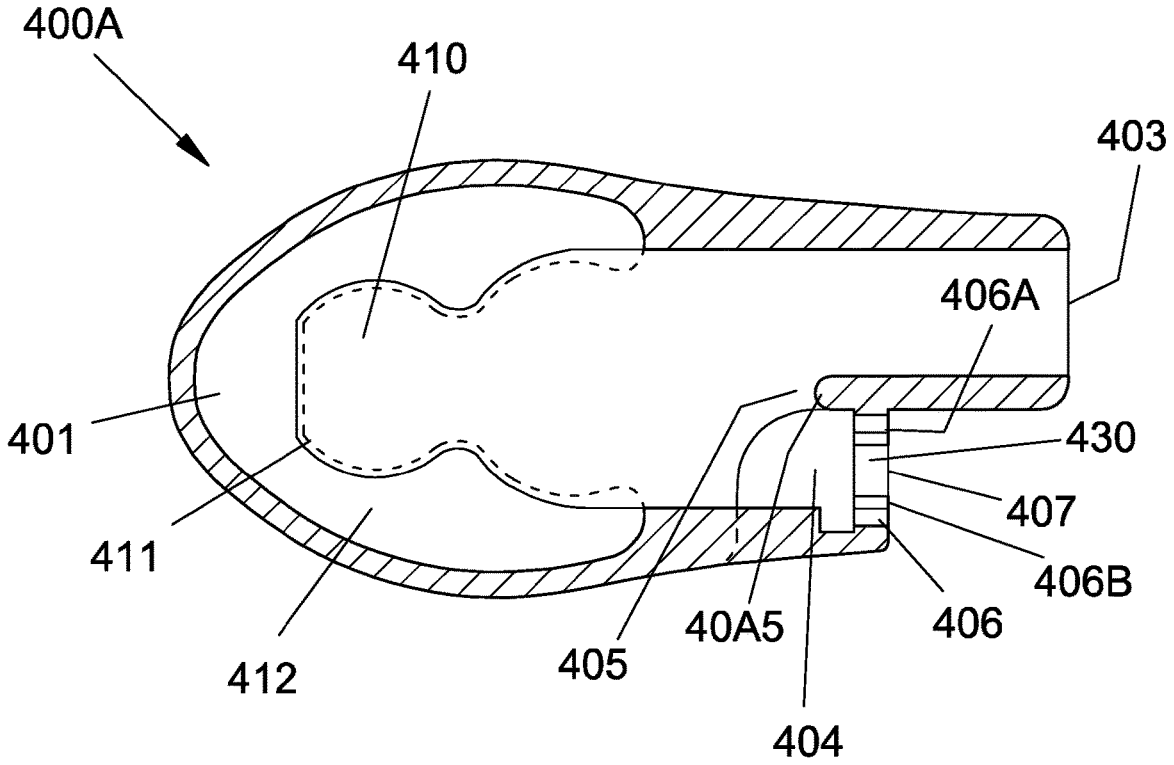
Figure 6A:
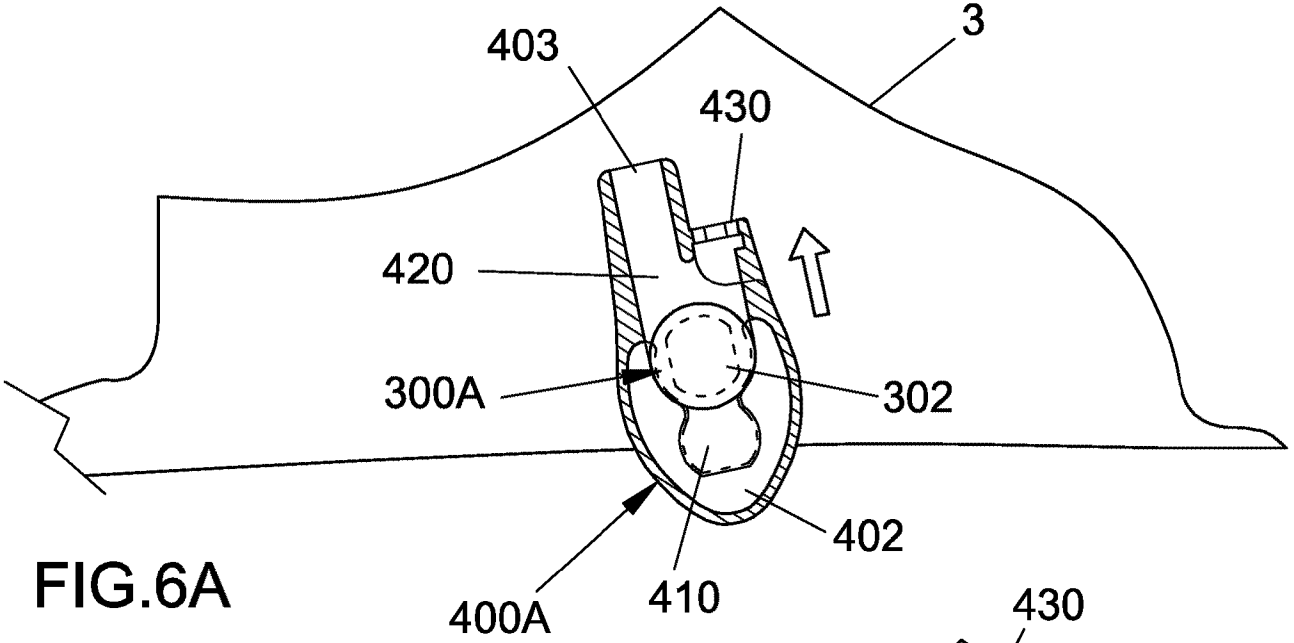
FIGS. 6A, 6B show the engagement modes of the buckle with the hinging pin.
Figure 6B:
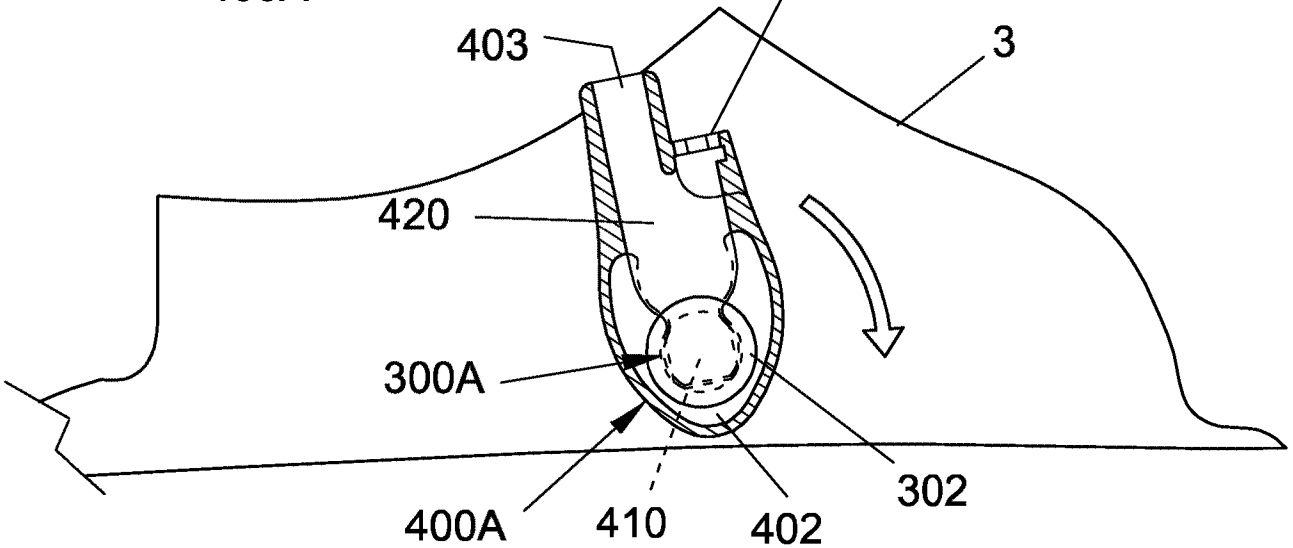
Figure 7A:
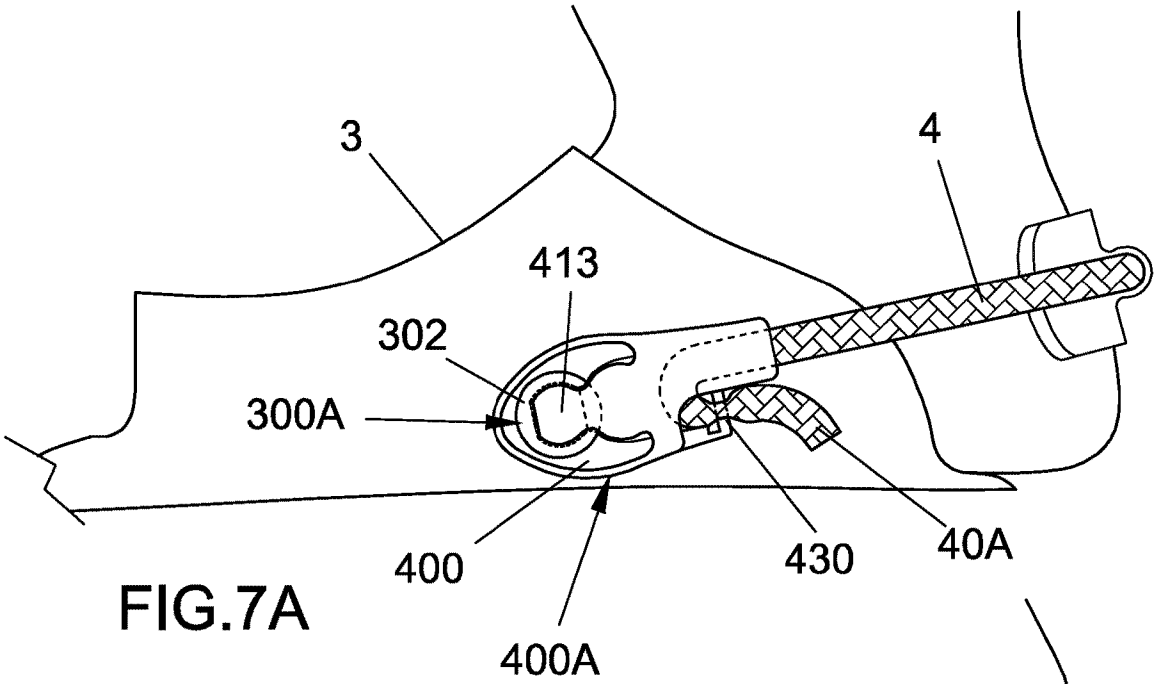
FIGS. 7A, 7B respectively show a view and a section of the buckle and the strap engaged on the user's heel.
Figure 7B:
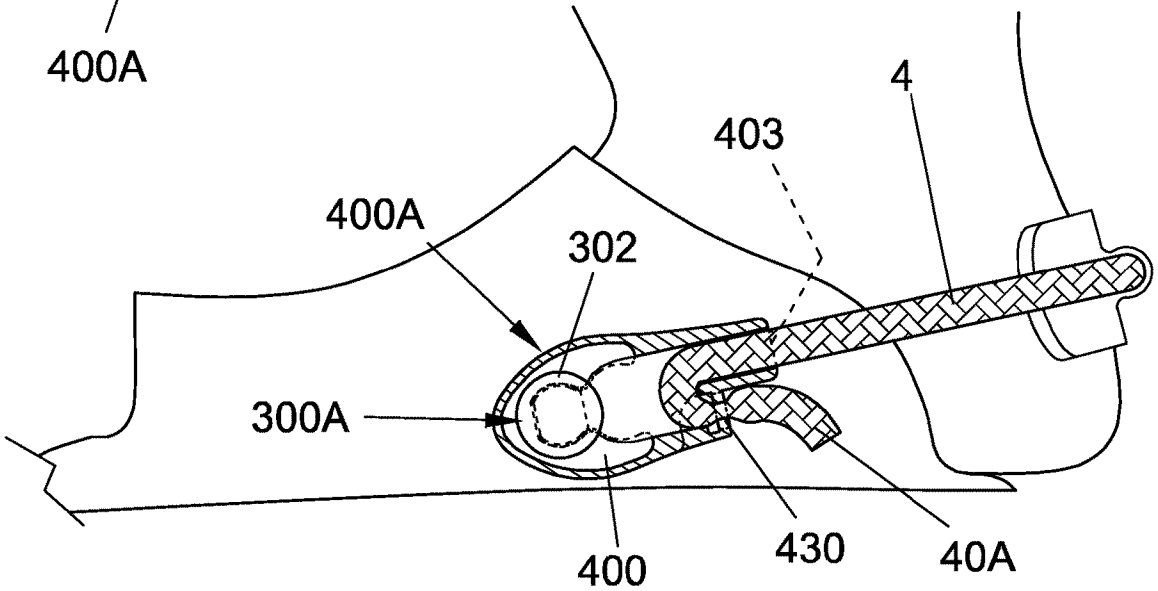

With reference to the figures cited, a swimming/scuba diving fin is shown and indicated in its entirety by reference number 1.

The fin 1 has a blade 2, a shoe open at the rear 3, and an adjustable elastic strap 4 engageable around the heel of the scuba diver.

The two opposite ends 40A and 40B of the strap 4 are connected to two buckles 400 A connected to respective hinging pins 300A projecting from the two opposed side walls of the shoe 3.

It should be noted that each buckle 400A, in other embodiments not illustrated, can be permanently or removably connected to the side wall of the shoe 3, fixed or rotatable, by the use or not of a pin.

At least one buckle 400A has a shaped hollow body 401 integrally forming a portion connecting to the side wall of the shoe, an axial sliding channel 420 of the elastic strap 4, and a releasable radial fastening clamp 430 of the elastic strap 4, that is to say releasable fastening clamp 430 acting on the elastic strap 4 transversally to the longitudinal dimension of the elastic strap 4.

In the case illustrated by way of example, the connecting portion comprises a housing 410 for the hinging pin 300A.

Advantageously, the buckle 400A which integrates the connection to the shoe open at the rear 3 and the adjustment of the adjustable elastic strap 4 is made as a single piece by moulding polymeric resins.

Such an axial sliding channel 420 has a hole 403 for the inlet of the elastic strap 4, a hole 404 for the outlet of the elastic strap 4 and a deflection angle 405 of the elastic strap 4 positioned between the inlet hole 403 and the outlet hole 404.

The inlet hole 403 and the outlet hole 404 lie on orthogonal planes.

The deflection angle 405 is defined by a throttle wall 405A of the elastic strap 4 inside the axial sliding channel 420.

The releasable radial fastening clamp 430 is positioned outside the axial sliding channel 420 of the elastic strap 4, and has two opposite jaws 406A and 406B which delimit a fastening groove 407 where the strap 4 can be introduced and extracted crosswise.

Appropriately, at least one of the two opposite jaws 406A, 406B has a toothing 416, where the toothing has tapered teeth.

The inlet hole 403 and the fastening groove 407 lie on parallel planes, and the fastening groove 407 is arranged in a staggered position and communicating with the outlet hole 404 of the axial sliding channel 420.

Typically, the adjustable elastic strap 4 is of constant circular section and consists of a bundle of threads in polymeric elastic material covered by a protective sheath of threads of greater unit diameter appropriately braided, the adjustable elastic strap 4 is configured to reduce the diameter thereof when it moves from a rest state to a state of tensile stress.

Appropriately, the two opposite jaws 406A and 406B have a reciprocal distance which is less than the diameter at rest of the elastic strap 4.

At least one hinging pin 300A has a stem 301 ending with an enlarged head 302 which in turn has a proximal base 303 which is proximal to the stem and a distal base 304 which is distal from the stem.

The housing 410 of the shaped hollow body 401 has an opening 411 for the passage of the stem 301 of the hinging pin 300A, surrounded by a resting shelf 412 for the proximal base 303 of the enlarged head 302 of the hinging pin 300A, and an elastically yielding tab 413 exerting on the distal base 304 of the enlarged head 302 of the hinging pin 300A an elastic force for retaining the proximal base 303 of the enlarged head 302 against the resting shelf 412.

The operation of the swimming/scuba diving fin according to the invention appears clear from the description and illustration and, in particular, is substantially as follows.

The fin, before being worn by the user, has the two buckles 400A rotationally connected in planes orthogonal to the axes of the respective hinging pins 300A projecting from the two opposed side walls of the shoe 3.

At least one of the two opposite ends 40A of the elastic strap 4 is connected to at least one of the two buckles 400A, typically both opposite ends 40A.

The end 40A of the elastic strap 4 enters the housing 410 of the shaped hollow body 401 through the inlet hole 403, slides into the axial sliding channel 420 defined by the throttle wall 405A of the deflection angle 405, exits from the outlet hole 404 and is locked in the radial fastening clamp 430 in the fastening groove 407 by the two opposite jaws 406A and 406B.

The buckle 400A is rotationally engaged with the hinging pin 300A through the stem 301 passing through the passage opening 411 of the shaped hollow body 401, and the proximal base 303 of the enlarged head 302 engaged against the resting shelf 412 by an elastic retention force exerted by the elastically yielding tab 413 on the distal base 304.

The user fits his/her foot, bare or with footwear, in the shoe open at the rear 3 and engages the adjustable elastic strap 4 around his/her heel: advantageously, the buckle 400A is free to rotate in a plane orthogonal to the axis of the hinging pin 300A, and thus allows the user to properly position the strap 4 around his/her heel.

The freedom of rotation of the buckle 400A around the rotation pin 300A advantageously allows the adjustment actions and the stresses on the strap 4 to be purely axial.

Therefore, the user laterally releases the elastic strap 4 from the radial fastening clamp 430 in which it is locked, and pulls the elastic strap 4 in one direction or the other—shortening or lengthening it by sliding it along the axial sliding channel 420 until a desired adjustment position is achieved.

Then, by keeping the elastic strap 4 provisionally locked in the adjustment position achieved thanks to the sliding resistance due to the throttle wall 405A, the user pulls the flap exiting the end 40A from the outlet hole 404.

The advantageous feature of the adjustable elastic strap 4 which is configured to reduce in diameter when it moves from a rest state to a state of tensile stress, allows the user to diametrically neck it under the tension applied, and thus easily introduce crosswise the flap exiting the end 40A now necked in the fastening groove 407 of the radial fastening clamp 430.

When the user then releases the applied tension, the flap exiting the end 40A of the adjustable elastic strap 4, by returning to the greater rest diameter is fastened by the radial fastening clamp 430 definitively locking the adjustable elastic strap 4 in the adjusting position thus chosen and defined.

Advantageously, for a subsequent modification of the adjusting position or for the total disengagement of the adjustable elastic strap 4 from the heel, the user pulls the flap exiting the end 40A from the outlet hole 404 until it is necked diametrically, and extracts across the flap exiting the end 40A necked by the fastening groove 407 of the radial fastening clamp 430, loosening the flap from the engagement and therefore being able to adjust it at his/her own discretion. It has in practice been found that a swimming/scuba diving fin according to the invention is particularly advantageous for having a heel strap which is easily adjustable and easily engageable in tension.

A swimming/scuba diving fin according to the invention is also particularly advantageous for having means for fastening the strap to the shoe open at the rear which allow a simple and effective insertion and engagement of the user's heel.

Not least, an advantage of the invention is that of making a swimming/scuba diving fin with a shoe open at the rear in which the fastening means of the elastic strap to the shoe open at the rear and the fastening means of the tension of the strap are integrated, simple and of compact design and made as a single piece by moulding polymer resins.

A swimming/scuba diving fin as conceived herein is susceptible to many modifications and variants, all falling within the scope of the inventive concept as defined by the claims; furthermore, all the details are replaceable by technically equivalent elements.

In practice, the materials used, as well as the dimensions, can be any according to the needs and the state of the art.

The invention claimed is:

1. A swimming/scuba diving fin comprising:

a blade;

a shoe open at a rear and comprising two opposed side walls;

an adjustable longitudinal elastic strap engageable around the heel of the scuba diver; and at least two buckles, disposed at opposite ends of said adjustable elastic strap, connected to said two opposed side walls of said shoe, wherein at least one said buckle comprises:

a shaped hollow body forming integrally a portion connecting to the side wall of the shoe;

a channel configured to axial slide said adjustable elastic strap; and a releasable fastening clamp of said adjustable elastic strap, said axial sliding channel comprising:

an inlet hole of said adjustable elastic strap;

an outlet hole of said adjustable elastic strap; and a deflection angle of said adjustable elastic strap positioned between said input hole and said outlet hole;

wherein said releasable fastening clamp is positioned outside said sliding channel.

2. The swimming/scuba diving fin according to claim 1, wherein said buckle is made as a single piece by molding polymer resins.

3. The swimming/scuba diving fin according to claim 1, wherein said adjustable elastic strap is configured to reduce in diameter when it moves from a rest state to a state of tensile stress.

4. The swimming/scuba diving fin according to claim 1, wherein said fastening clamp comprises two opposite jaws that delimit a fastening groove where said adjustable elastic strap can be introduced and extracted crosswise.

5. The swimming/scuba diving fin according to claim 4, wherein said opposite jaws have a reciprocal distance that is less than the diameter at rest of said adjustable elastic strap.

6. The swimming/scuba diving fin according to claim 4, wherein said fastening groove is arranged in a staggered position and communicating with said outlet hole of said channel for the axial sliding of said adjustable elastic strap.

7. The swimming/scuba diving fin according to claim 1, wherein said inlet hole and said outlet hole lie on orthogonal planes.

8. The swimming/scuba diving fin according to claim 4, wherein said inlet hole and said fastening groove lie on parallel planes.

9. The swimming/scuba diving fin according to claim 4, wherein at least one of said two opposite jaws comprises a toothing.

10. The swimming/scuba diving fin according to claim 9, wherein said toothing has tapered teeth.

11. The swimming/scuba diving fin according to claim 1, wherein said deflection angle is defined by a throttle wall of said adjustable elastic strap inside said axial sliding channel, said throttle wall comprising a surface within the axial sliding channel that redirects the adjustable elastic strap between the inlet hole and the outlet hole.

12. The swimming/scuba diving fin according to claim 1, wherein said connecting portion comprises a housing configured to accept a hinging pin that extends from said side wall of said shoe, said hinging pin comprises:

a stem ending with an enlarged head in turn having a proximal base that is proximal to said stem and a distal base that is distal from said stem, and in that said housing of said shaped hollow body has an opening for the passage of said hinging stem surrounded by a resting shelf for said proximal base of said enlarged head, and an elastically yielding tab exerting on the distal base of said enlarged head an elastic force for retaining said proximal base against said resting shelf.

13. A method for adjusting said adjustable elastic strap of said one swimming/scuba diving fin according to claim 1, comprising the steps of:

pulling in one direction or the other said adjustable elastic strap by sliding the strap along said axial sliding channel until it reaches a desired adjusting position, maintaining said adjustable elastic strap provisionally blocked in said adjusting position achieved by the resistance to sliding due to said throttle wall, pulling said flap exiting the end from said outlet hole until it is necked diametrically under the tension applied, introducing crosswise said flap exiting the end necked in said fastening groove of said fastening clamp, and releasing the pull on the flap exiting the end that by returning to the greater rest diameter is fastened by said fastening clamp locking definitively said adjustable elastic strap in said adjusting position.

14. The method for adjusting said adjustable elastic strap of said one swimming/scuba diving fin according to claim 13, further comprising the steps of:

pulling said flap exiting the end from said outlet hole until it is necked diametrically, and extracting across said flap exiting the end necked by said fastening groove of said fastening clamp loosening the flap from the engagement for a subsequent modification of the adjusting position.

15. A swimming/scuba diving fin comprising:

a blade;

a shoe open at a rear and comprising two opposed side walls;

an adjustable longitudinal elastic strap engageable around the heel of the scuba diver; and at least two buckles, disposed at opposite ends of said adjustable elastic strap, connected to said two opposed side walls of said shoe, wherein at least one said buckle comprises:

a shaped hollow body forming integrally a portion connecting to the side wall of the shoe;

a channel configured to axial slide said adjustable elastic strap; and a releasable fastening clamp of said adjustable elastic strap, said axial sliding channel comprising:

an inlet hole of said adjustable elastic strap;

an outlet hole of said adjustable elastic strap; and a deflection angle of said adjustable elastic strap positioned between said input hole and said outlet hole;

wherein said fastening clamp comprises two opposite jaws that delimit a fastening groove where said adjustable elastic strap can be introduced and extracted crosswise.

16. A swimming/scuba diving fin comprising:

a blade;

a shoe open at a rear and comprising two opposed side walls;

an adjustable longitudinal elastic strap engageable around the heel of the scuba diver; and at least two buckles, disposed at opposite ends of said adjustable elastic strap, connected to said two opposed side walls of said shoe, wherein at least one said buckle comprises:

a shaped hollow body forming integrally a portion connecting to the side wall of the shoe;

a channel configured to axial slide said adjustable elastic strap; and a releasable fastening clamp of said adjustable elastic strap, said axial sliding channel comprising:

an inlet hole of said adjustable elastic strap;

an outlet hole of said adjustable elastic strap; and a deflection angle of said adjustable elastic strap positioned between said input hole and said outlet hole;

wherein said inlet hole and said outlet hole lie on orthogonal planes.

17. The swimming/scuba diving fin according to claim 15, wherein said releasable fastening clamp is positioned outside said sliding channel.

18. The swimming/scuba diving fin according to claim 16, wherein said releasable fastening clamp is positioned outside said sliding channel.

* * * * *